US011076681B2

(12) United States Patent
Pires et al.

(10) Patent No.: US 11,076,681 B2
(45) Date of Patent: Aug. 3, 2021

(54) ADJUSTABLE APPLICATOR

(71) Applicant: ZEN DESIGN SOLUTIONS LIMITED, Kowloon (HK)

(72) Inventors: Leo Clifford Pires, Basking Ridge, NJ (US); Roger Hwang, Maple (CA); Rahul Bose, New Delhi (IN); Manisha Kohli, New Delhi (IN); Iti Seth, Faridabad (IN)

(73) Assignee: ZEN DESIGN SOLUTIONS LIMITED, Kowloon (HK)

( * ) Notice: Subject to any disclaimer, the term of this patent is extended or adjusted under 35 U.S.C. 154(b) by 474 days.

(21) Appl. No.: 15/853,212

(22) Filed: Dec. 22, 2017

(65) Prior Publication Data

US 2018/0177281 A1 Jun. 28, 2018

(30) Foreign Application Priority Data

Dec. 28, 2016 (IN) ..... 201611044576

(51) Int. Cl.
*A45D 40/26* (2006.01)

(52) U.S. Cl.
CPC ..... *A45D 40/264* (2013.01); *A45D 40/265* (2013.01); *A45D 40/267* (2013.01); *A46B 2200/1053* (2013.01)

(58) Field of Classification Search
CPC .. A45D 34/042; A45D 40/262; A45D 40/264; A45D 40/265; A45D 40/267; A46B 7/02; A46B 7/023; A46B 7/026
USPC ..... 15/171, 201, 203
See application file for complete search history.

(56) References Cited

U.S. PATENT DOCUMENTS

| | | | | |
|---|---|---|---|---|
| 3,998,235 | A | 12/1976 | Kingsford | |
| 4,446,880 | A * | 5/1984 | Gueret | A45D 40/265 132/218 |
| 5,722,436 | A | 3/1998 | Vandromme et al. | |
| 6,345,626 | B1 | 2/2002 | Bouix | |
| 2010/0200013 | A1* | 8/2010 | Kim | A45D 40/265 132/218 |

FOREIGN PATENT DOCUMENTS

EP 2878223 B1 * 11/2013

* cited by examiner

*Primary Examiner* — Rachel R Steitz
(74) *Attorney, Agent, or Firm* — Patterson + Sheridan, LLP

(57) ABSTRACT

An adjustable applicator for applying a cosmetic or personal care composition, e.g. mascara to eyelashes or eyebrows. The adjustable applicator extends along a longitudinal axis and comprises of an applicator head, a stem, an inner rod and an actuator. The inner rod extending through the applicator head is capable of moving along a longitudinal axis of the adjustable applicator to cause progressive modification in shape of the applicator head by releasing and applying force on the applicator head.

20 Claims, 11 Drawing Sheets

ADJUSTABLE APPLICATOR

CROSS-REFERENCE TO RELATED APPLICATION

This application claims benefit of priority to Indian Provisional Application Ser. No. 201611044576, filed on Dec. 28, 2016, which is incorporated by reference in its entirety.

BACKGROUND

Field of the Invention

Embodiments of the present disclosure relate to an adjustable applicator for applying a cosmetic or personal care composition, e.g. mascara to eyelashes or eyebrows. More particularly, the disclosure, relates to an applicator that can be adjusted as per user's convenience for application of a cosmetic or a care product.

Description of the Related Art

Mascara, an important make-up accessory used to darken and define eyelashes to accentuate the eyes, is difficult to apply because of the target area of application. The eyelashes offer a very small application area, while being soft, flexible, delicate and in close proximity to very sensitive eye tissue. Therefore, a mascara product would be liked by the consumers when a right kind of applicator is provided to them for easy application as the overall consumer experience depends on both the product and on the applicator used to apply it.

Conventional mascara brushes are in the form of a generally cylindrical straight rod carrying a plurality of bristles extending radially outwardly from its outer surface. However, straight mascara brushes are not thought by some people to be ideal for all purposes and curved mascara brushes are also known.

One applicator may be generally straight and have short, densely arrayed bristles and may be employed for applying mascara to eyelashes to achieve a desired effect (e.g. to volumize eyelashes). While another applicator may incorporate a bend and have longer, less densely arrayed bristles for applying mascara to eyelashes to achieve an alternative desired effect (e.g., to separate and define eyelashes).

Curved mascara brushes permit contact of the brush with more eyelashes along a correspondingly curved eyelid. However, the curved brush is more difficult to use in the confines of the eye area, particularly the corners of the eye where a straight brush works better. Another drawback of pre-curved brush is that it is not readily adjustable to confirm to a particular user's eyelid curvature. In addition, the curvature of the upper and lower eyelids is rarely the same and a brush curved to fit the upper lid will not properly fit the lower lid.

Adjustable mascara brushes are known in the prior art. It is known to provide adjustment of the angle of the brush or applicator relative to the applicator wand or handle.

Thus, existing applicators have limited functionality and are not conducive to applying mascara to eyelashes using different techniques and/or different orientations. Accordingly, there remains a need in the art for improved applicator systems that allow application of mascara using different techniques and/or orientations to achieve multiple desired effects.

Therefore, there exists a need for an applicator that provides ease-of-use as well as is modifiable to adapt to the shape requirement of the user.

SUMMARY

The present disclosure generally is an adjustable applicator employed for application of a cosmetic or a care product such as for application of mascara, coloring strands of hair, for dental flossing or for applying pharmaceuticals or cleaning agents. The use of adjustable applicator of the present disclosure for removal of make-up products is also contemplated.

According to an embodiment of the present disclosure, there is provided an adjustable applicator including an applicator head that can be adjusted as per user's convenience for application of a cosmetic or a care product.

In accordance with an embodiment of the disclosure, the adjustable applicator extends along a longitudinal axis and comprises of an applicator head, a stem and a gripping member wherein the applicator head is connected at a distal end of the stem and the gripping member is connected at a proximal end of the stem.

In accordance with an embodiment of the disclosure, the adjustable applicator includes an actuator formed by an upper portion of the gripping member, which when actuated initiates a mechanism for progressive modification in the shape of the applicator head.

According to an embodiment of the disclosure, there is provided an inner rod extending through the applicator head and which is capable of moving along the longitudinal axis to cause progressive modification in shape of the applicator head by releasing and applying force on the applicator head.

According to an embodiment of the disclosure, the adjustable applicator comprises an inner rod extending through the applicator head, the stem and the gripping member. A distal end of the inner rod is fixedly connected at a distal end of the applicator head and a proximal end of the inner rod is connected to the actuator. The actuator is actuated for moving the inner rod along the longitudinal axis to cause progressive modification in shape of the applicator head.

According to an embodiment of the disclosure, the inner rod may alternatively be connected by way of a locking arrangement with the distal end of the applicator head thereby guiding the movement of the applicator head. For example, when the inner rod is lifted or moved towards proximal direction it causes the applicator head to be bent in a way that the distal end of the applicator head moves towards the proximal end of the applicator head while when the inner rod is lowered or moved towards distal direction it causes the distal end of the applicator head to move away from the proximal end of the applicator head.

According to another embodiment of the disclosure, the applicator head comprises at least two support members defining an opening between them and a plurality of application elements are present on at least a portion of an outer surface of the at least two support members. Each of the at least two support members has a proximal portion and a distal portion.

According to another embodiment of the disclosure, the plurality of application elements are chosen from a group of application elements consisting of tines, bristles, teeth, discs, ribs and flocking.

According to another embodiment of the disclosure, each of the at least two support members, has a width greater than a thickness along its entire length. Further, the width of each of the at least two support members is more in distal portion of its length than in proximal portion of its length.

According to another embodiment of the disclosure, each of the at least two support members, has more number of application elements in the distal portion of its length than in the proximal portion of its length.

According to another embodiment of the disclosure, each of the at least two support members, has more number of application elements in distal half of its length than in proximal half of its length.

According to another embodiment of the disclosure, each of the at least two support members, has more number of rows of tines in distal half of its length than in proximal half of its length.

According to another embodiment of the disclosure, each of the at least two support members, has at least three rows of tines in distal half of its length and only single row of tines in proximal half of its length.

According to another embodiment of the disclosure, free ends of application elements of one of the at least two support members face in a direction opposite to a direction of free ends of application elements of other of the at least two support members.

According to an embodiment of the disclosure, when the actuator is actuated, the applicator head can adopt at least two stable configurations that is to say a first configuration in which the inner rod is moved to its maximum extent towards proximal direction and a second configuration in which the inner rod is moved to its maximum extent towards distal direction.

According to an embodiment of the disclosure, in the first configuration, the distal end of the applicator head is moved to its maximum extend towards the proximal end of the applicator head and in the second configuration, the distal end of the applicator head is moved to its maximum extent away from the proximal end of the applicator head.

According to an embodiment of the disclosure, in the first configuration, a portion of the applicator head is extended in a direction perpendicular to the longitudinal axis of the adjustable applicator. In other words, the adjustable applicator adopts a T-shape in the first configuration and in the second configuration, the applicator head is extended along the longitudinal axis of the adjustable applicator.

According to an alternate embodiment of the disclosure, in the first configuration, a portion of the applicator head is extended in a horizontal direction and in the second configuration, the applicator head is extended along the longitudinal axis of the adjustable applicator.

According to an alternate embodiment of the disclosure, in the first configuration, at least a part of a distal portion of each of the at least two support members is extended in a horizontal direction which is perpendicular to the longitudinal axis of the adjustable applicator and in the second configuration, each of the at least two support members is extended along the longitudinal axis of the adjustable applicator.

According to an alternate embodiment of the disclosure, in the first configuration, at least distal half of the length of each of the at least two support members of the applicator head is extended in a horizontal direction or in a direction perpendicular to the longitudinal axis of the adjustable applicator and in the second configuration, the at least two support members of the applicator head are extended along the longitudinal axis of the adjustable applicator.

According to an alternate embodiment of the disclosure, in the first configuration, a majority of the plurality of application elements present on the outer surface of the at least two support members are parallel to the longitudinal axis of the adjustable applicator; and wherein in the second configuration, a majority of the plurality of application elements present on the outer surface of the at least two support members are non-parallel to the longitudinal axis of the adjustable applicator.

According to an alternate embodiment of the disclosure, in an improved mode of implementation, provision may be made for the applicator head to be maintained in intermediate state wherein in one of the intermediate state a distal portion of the applicator head forms a V-shape and a proximal portion of the applicator head forms an inverted V-shape.

According to an alternate embodiment of the disclosure, in other intermediate states the distal portion of each of the at least two support members form an angle more than zero degree but less than 90 degree with the longitudinal axis of the adjustable applicator.

According to another embodiment of the disclosure, the at least two support members of the applicator head may be molded as a single piece from an elastically deformable or a flexible material. The support members may be produced from an elastomer or any other elastic material allowing compression and expansion of the support members or may be made from any other polymeric material which is flexible in nature.

According to another embodiment of the disclosure, the at least two support members of the applicator head may be molded by bi-injecting two materials having different properties for e.g. different hardness, color etc.

According to another embodiment of the disclosure, the inner rod may be made out of a material selected from a polymeric material and metals.

Independently or in combination with the above, exemplary embodiments of the disclosure provide a cosmetic package for packaging and dispensing a substance, for example, a cosmetic package, comprising an applicator as defined above. The cosmetic package may comprise a receptacle and an adjustable applicator. The adjustable applicator in such a cosmetic package may comprise a gripping member, a stem having a cavity, an applicator head having at least two support members and an inner rod extending between the applicator head and the gripping member. The stem may be connected to the applicator head at one end and to the gripping member at another end. The said cosmetic package may also include a wiper member. A lower portion of the gripping member may form a cap/sleeve for closing the receptacle and an upper portion of the gripping member may form an actuator for adjusting the shape of the applicator head. The actuator is connected to a proximal end of the inner rod in such a way that rotational movement of the inner rod with respect to the actuator is restricted while translational movement is allowed and the inner rod is non-rotatably connected at its distal end to a distal end of the applicator head.

According to an embodiment of the disclosure, the inner rod is locked in a cavity at the distal end of the applicator head and runs through an opening between the at least two support members into a cavity formed in a proximal portion of the applicator head and then into the hollow stem and the actuator. The proximal portion of the applicator head forms a shank which is connected at a distal end of the hollow stem.

According to an embodiment of the disclosure, the actuator can be a dialer, a slider, a push button and the like which can be actuated using manual, mechanical, magnetic, electrical or any other suitable force.

According to an embodiment of the disclosure, the actuator has a closed-end cylindrical shape which is provided with a tube portion having a small outer diameter. The actuator further includes an internal annular skirt having an inner profile, such as mating threads capable of interacting with an outer thread of the inner rod mounted axially inside the actuator.

According to yet another embodiment of the present disclosure, for guiding axial movement of the inner rod and for preventing inner rod from rotating, when the actuator is actuated, there is provided longitudinal guide protrusions in interior surface of an inner cylinder of the cap/sleeve. However in alternate embodiments, the longitudinal guide protrusions may be provided in stem member or both in stem member and inner cylinder of the cap.

According to another embodiment of the disclosure, the actuator is capable of assuming a locked configuration and an unlocked configuration. In the locked configuration, the actuator cannot be actuated to change the shape of applicator head. In the unlocked configuration, the actuator can be actuated to change the shape of the applicator head.

According to an embodiment of the disclosure, there is provided a locking member which engages and disengages with the actuator to respectively lock and unlock the actuation of the actuator in respective locked and unlocked configuration.

According to an embodiment of the disclosure, the gripping member further comprises, the sleeve connected to the actuator and the locking member inside the sleeve which is configured to detachably connect to the actuator. The actuator could be connected to the inner rod in such a way that rotational movement of the inner rod with respect to the sleeve is restricted while translational movement is allowed. The stem housing the inner rod is non-rotatable with respect to the sleeve.

According to an embodiment of the disclosure, when the adjustable applicator is removed/disengaged from the receptacle, the actuator assumes the unlocked configuration in which the actuator can be actuated with respect to the sleeve. In the unlocked configuration, a user is able to actuate the actuator thereby the inner rod which is housed within the stem is lifted or lowered for transforming the shape/profile of the applicator head.

When the adjustable applicator is retained on the container, the actuator takes up the locked configuration, in which the user is unable to actuate the actuator with respect to the sleeve; therefore the shape of the applicator head does not change when the device is in closed position.

According to an embodiment of the present disclosure, the actuator is a dialer attached with the sleeve of the gripping member such that the dialer is free to rotate with respect to the sleeve. According to an embodiment, the dialer is attached to the sleeve via a snap-fit system comprising the external annular protruding portion and a complementary annular groove of the sleeve.

According to yet another embodiment of the present disclosure, the sleeve comprises two concentric cylinders joined together by linking ribs, i.e. a larger diameter outer cylinder is disposed around a hollow inner cylinder and the linking ribs are connected from the inner cylinder to the outer cylinder. According to a preferred embodiment, the linking ribs are radially disposed such that there are hollow spaces between the adjacent linking ribs. The outer cylinder comprises the internal annular groove for attaching to the external annular protruding portion of the dialer.

According to yet another embodiment of the present disclosure, for engaging the stem to the sleeve, a portion of inner cylinder is inserted/received into an upper tubular portion of the stem and a groove at the outer surface of inner cylinder mates with complementary protrusion present on the inner surface of the upper tubular portion of the stem. However, in alternate embodiments, the stem may be received in the inner cylinder for the engagement. Further, for non-rotatably locking the stem and the sleeve together, on the interfaces where the stem is joined to the sleeve, the stem and the sleeve both have complementary longitudinal protrusions and positioning longitudinal grooves that engage with each other. However, it is not beyond the ambit of the present disclosure that any other non-rotatable engagement known in the art may be employed for locking any relative rotation between the stem and the sleeve.

According to yet another embodiment of the present disclosure, the stem comprises the upper tubular portion, a downward skirt, a joint defined between the upper tubular portion and the downward skirt, and an elongated hollow shaft. An inner thread is provided on the inner peripheral surface of the downward skirt of the stem which is adapted to attach the gripping member to an externally threaded neck of the receptacle. With the cap so attached, the applicator head is immersed in product to be applied. The elongated hollow shaft extends beyond the neck in the container. Preferably, the hollow shaft of the stem member is disposed around at least a portion of the inner rod that is longitudinally movable with respect to the shaft.

According to yet another embodiment of the present disclosure, the gripping member further includes such features that allow an axial movement of the inner rod but rotation of the inner rod is prevented when the dialer is rotated with respect to the sleeve. For example, the inner rod includes two annular flanges having two opposing slide cut-outs for receiving the longitudinal guide protrusions of the sleeve which prevent rotation of the inner rod. Further, one or more annular ribs and sealing O-rings are configured around the inner rod so that the inner rod interfaces tightly against an inner wall of the shaft. The annular ribs and the sealing O-rings prevent the product from leaking and ensure steady, smooth, and noiseless extension of the inner rod along the shaft.

In unlocked configuration of the cosmetic package, when the dialer is actuated with respect to the cap, the inner rod moves longitudinally with respect to the stem which causes variation in the shape of the applicator head. When a suitable adjustment of the shape of the applicator head has been made it will be retained while the adjustable applicator is used. The adjustment is retained until the user intentionally actuates the dialer and sleeve with respect to each other once again to achieve a different adjustment.

According to yet another embodiment of the present disclosure, to prevent the dialer from rotating with respect to the sleeve in the locked configuration, there is provided in the cap, the locking member. The locking member has a barrel body having teeth at its first end and an annular shoulder defined at outer periphery of the barrel body. The locking member is slidably mounted in an annular space defined between the sleeve and the stem. In the locked configuration, the teeth of the barrel body engage with complementary teeth of the dialer. The locking member further includes longitudinal cut outs on the barrel body, the longitudinal cut outs open at the peripheral edge of the barrel body having teeth.

According to yet another embodiment of the present disclosure, there is provided a spring that surrounds a portion of the locking member above the shoulder of the barrel body such that one end of the spring abuts linking ribs of the sleeve and its other end abuts the shoulder of the locking member and wherein spring urges the locking member away from the dialer.

According to yet another embodiment of the present disclosure, the longitudinal cut outs are provided on the locking member so that the top part of the locking member may slide through hollow spaces between the linking ribs of the sleeve to engage with the dialer for non-rotatably engaging the locking member with the sleeve.

According to yet another embodiment of the present disclosure, when the adjustable applicator is screwed on the container, the container shoulder abuts the distal end of the locking member and exerts an upward sliding force upon the locking member pushing it upward against the downward biasing force of the spring thereby compressing the spring and engaging the teeth of the locking member with the complementary teeth of the dialer. In the closed position of the package, the dialer, the sleeve, and the stem member and the locking member are engaged in non-rotatable manner with respect to one other. Therefore, the dialer can't be actuated independently of the sleeve i.e. when the dialer is rotated the sleeve also rotates simultaneously as the locking member engages dialer to the sleeve in a non-rotatable engagement. Moreover, the sleeve is also non-rotatably engaged to the stem and therefore, it causes rotation of the cap in whole and rotation thus leads to unscrewing of the cap from the receptacle without causing actuation of the dialer.

According to yet another embodiment of the present disclosure, once the cap is unscrewed, the locking member is pushed downward due to biasing/restoring force of the spring and the locking member slides downwards disengaging itself from the dialer. The dialer thus becomes free to rotate with respect to sleeve. Now to transform the profile of the applicator head, the dialer is twisted and the rotational movement is converted into translational movement of the inner rod by the rotational movement of threads within the inner skirt of the dialer. Therefore, the inner rod is now able to extend or retract toward/away from the distal end of the shaft. As the inner rod is extended or retracted, the profile of applicator head changes due to pressure applied on it by axial movement of the inner rod. The inner rod can be adjusted to various relative longitudinal positions with respect to the shaft depending on degree of twisting, such that as adjustment is made, profile of the applicator head varies. Once the adjustment is made, it will be retained without any action by the user, until further adjustment is desired and intentionally made.

According to yet another embodiment of the present disclosure, to avoid the inner rod from being moved completely out of the internal threads of the dialer when the dialer is rotated, there is provided a projecting stop on inner surface of outer cylinder which prevents the complete or over-rotation of the dialer i.e. the dialer cannot be rotated to 360 degree or more with respect to the sleeve in one particular direction and therefore doesn't run out of length of the internal threads of the dialer.

According to yet another embodiment of the present disclosure, the threads of the dialer and threads screwing the gripping member to receptacle are preferably threads in opposite directions.

According to yet another embodiment of the present disclosure, the materials suitable for forming the receptacle could be polypropylene while the dialer, the cap, the inner rod, the stem member, and the locking member could be formed of acrylonitrile butadiene styrene, PP, TPE or any other suitable polymeric material. The material of inner rod could be any polymeric material as nylon, PP, TPE or could be a suitable metal. The stem may be formed of polyacetal or any other suitable polymeric material. The material for forming wiper could be low-density polyethylene. The aforementioned materials for forming various parts of the cosmetic package of the present disclosure are an example, however other suitable materials may also be used.

The above and other objects, features and advantages of the present disclosure will become clear from the following description of the preferred embodiments when the same is read in conjunction with the accompanying drawings.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

Figure 1:
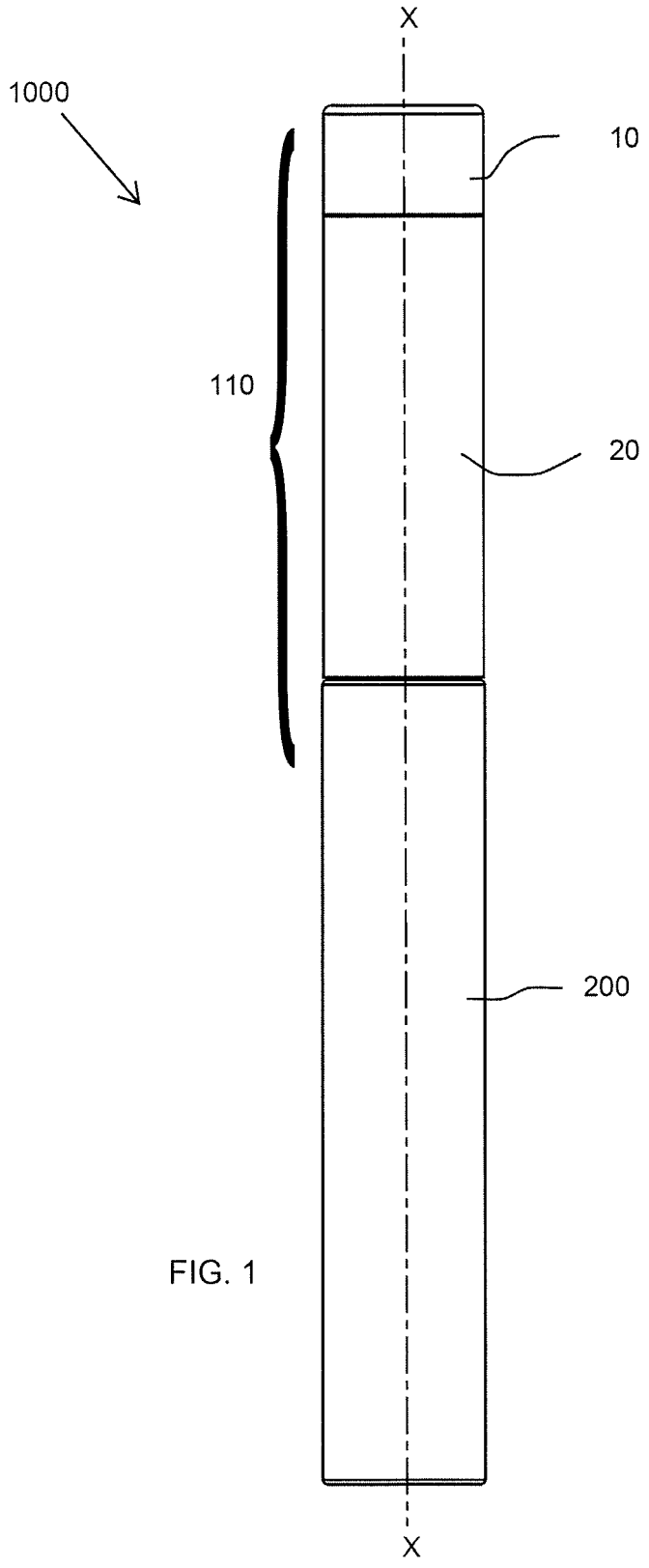
FIG. 1 illustrates a front view of a cosmetic package in closed position according to an embodiment of the present disclosure.

To facilitate understanding, identical reference numerals have been used, where possible, to designate identical elements that are common to the figures. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 2:
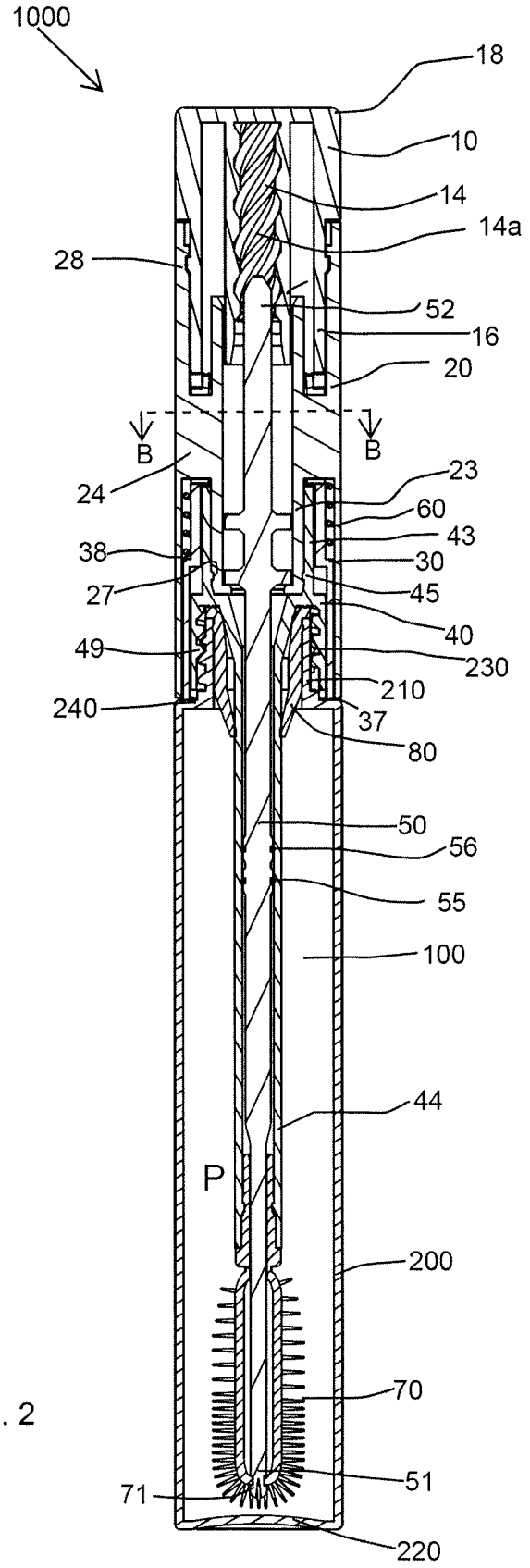
FIG. 2 illustrates a cross sectional view of the cosmetic package of FIG. 1.

FIGS. 1 and 2 show a cosmetic package 1000 in accordance with the present disclosure, in a closed position. The cosmetic package 1000 includes an applicator head 70 which can be adjusted as per user's convenience for application of a product including a cosmetic or a care product. The cosmetic package 1000 having a longitudinal axis X—X, comprises an adjustable applicator 100 and a receptacle 200. The receptacle 200 and the adjustable applicator 100 are intended to be fastened to each other by screwing. The receptacle 200 includes a neck 210 extending along the longitudinal axis X-X, a shoulder 240 and an end wall 220 forming a reservoir for a product P. The adjustable applicator 100 includes a gripping member 110 suitable for closing the receptacle 200, the applicator head 70 and a stem 40 having a cavity 48 (see FIG. 11). The stem 40 may be connected to the application member 70 at one end and to the gripping member 110 at another end. The applicator head 70 is secured to the stem 40 and intended for being inserted in said receptacle 200 in order to be loaded with the product P to be applied.

The neck 210 of the receptacle 200 is provided with an external thread 230 intended for cooperating with a complementary thread 49 carried by the stem 40, allowing the receptacle 200 to be closed by screwing.

For some cosmetic products, such as mascara or a lip gloss, it is preferable to provide a wiper 80 positioned into the neck 210 of the receptacle 200 to wipe excess product P from the adjustable applicator 100 as the adjustable applicator 100 is withdrawn from the receptacle 200. The wiper 80 is preferably made of an elastomeric plastic material or any other polymeric material.

The adjustable applicator 100 includes an inner rod 50 having a distal end 51 and a proximal end 52. The distal end 51 of the inner rod 50 is connected at a distal end of the applicator head 70 and a proximal end 52 of the inner rod 50 is connected to a dialer 10 of the adjustable applicator 100.

As shown in FIGS. 1-3*b*, the gripping member 110 comprises an upper portion comprising the dialer 10 and a lower portion comprising a cap or a sleeve 20 connected to the dialer 10. According to other embodiments, the dialer 10 can be replaced by other actuator selected from a group consisting of a slider, a push button and the like which can be actuated using manual, mechanical, magnetic, electrical or any other suitable force.

A locking member 30 is housed within the sleeve 20 and is configured to detachably connect to the dialer 10. The stem 40 is non-rotatable with respect to the sleeve 20.

Figure 3A:
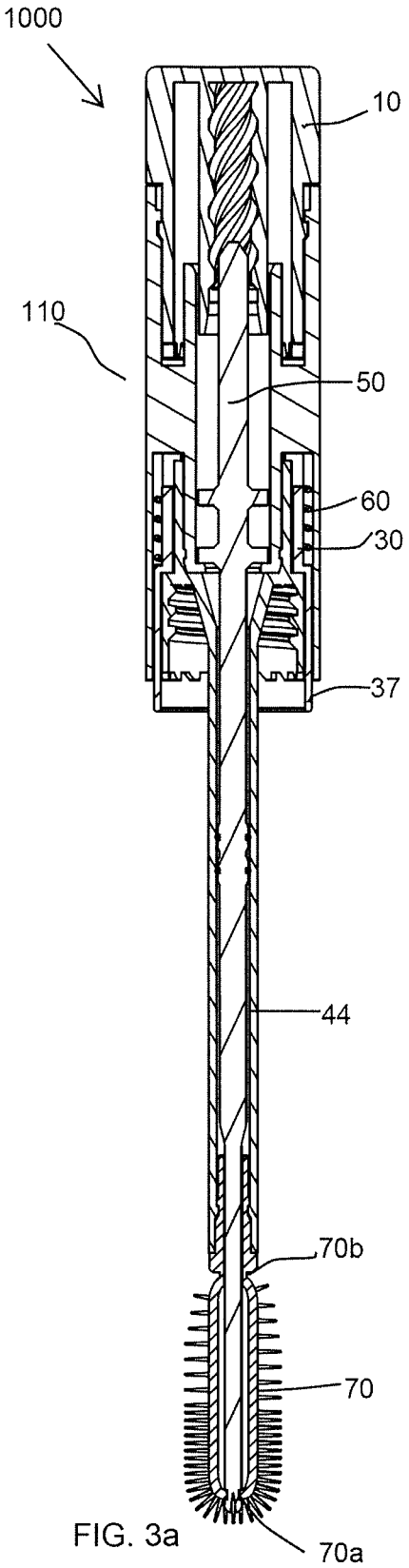
FIG. 3*a* illustrates a cross sectional view of an adjustable applicator of the cosmetic package of FIG. 2.
Figure 3B:
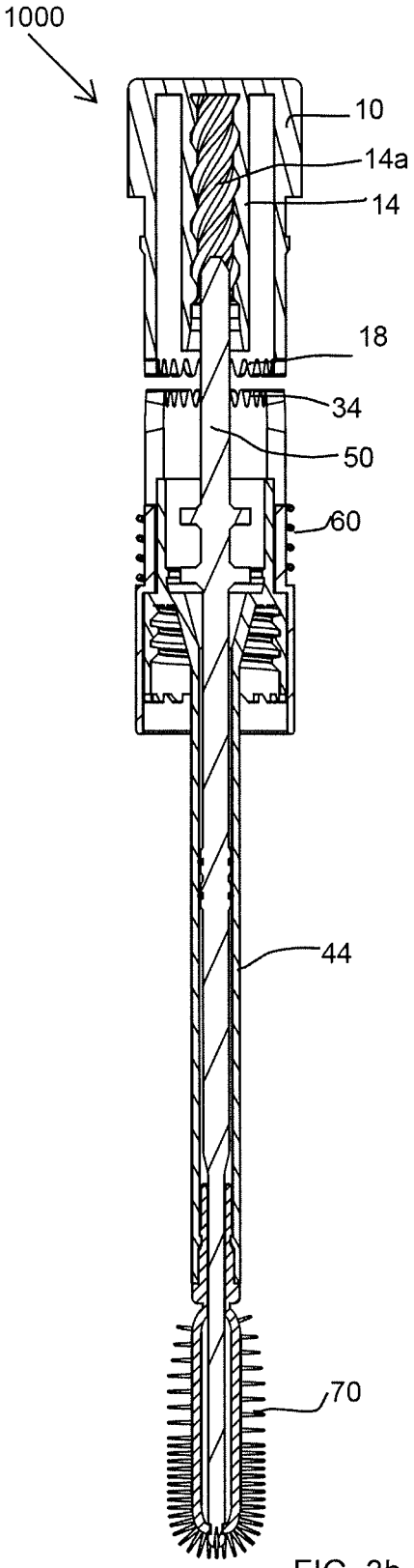
FIG. 3*b* illustrates a cross sectional view of an adjustable applicator of the cosmetic package of FIG. 2 with lower portion of the gripping member hidden.

According to an embodiment of the present disclosure, the dialer 10 is capable of assuming a locked configuration as shown in FIGS. 1 and 2 and an unlocked configuration as shown in FIGS. 3*a* and 3*b*.

As shown in FIGS. 1 and 2, when the applicator 100 is retained on the receptacle 200, the dialer 10 takes up the locked configuration, in which the user is unable to rotate the dialer 10 with respect to the sleeve 20 of the gripping member 110. As shown in FIGS. 3*a* and 3*b*, when the adjustable applicator 100 is removed/disengaged from the receptacle 200, the dialer 10 assumes the unlocked configuration in which the dialer 10 is rotatable with respect to the sleeve 20 of the gripping member 110. The locking and unlocking mechanism of the dialer 10 along with the other details of the cosmetic package 1000 will be explained in detail later.

In the unlocked configuration, the dialer 10 is rotated for moving the inner rod 50 along the longitudinal axis X—X of the adjustable applicator 100 to cause progressive modification in shape of the applicator head 70.

Figure 6A:
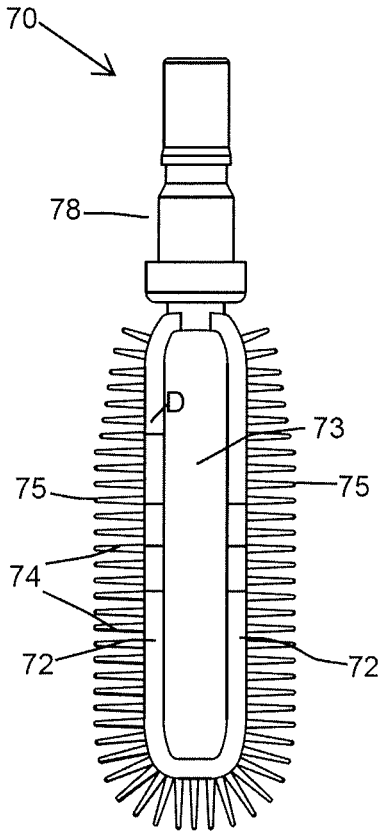
FIGS. 6*a* to 6*c* illustrate a front view, a side view and a perspective view respectively of the applicator head of FIG. 4 in a second configuration.
Figure 6B:
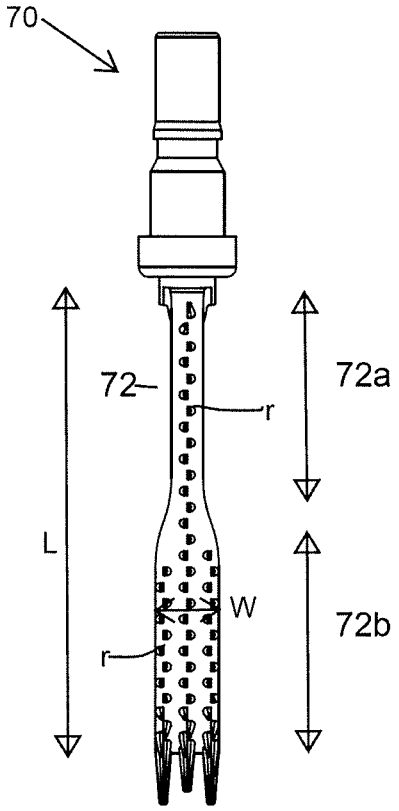
Figure 6C:
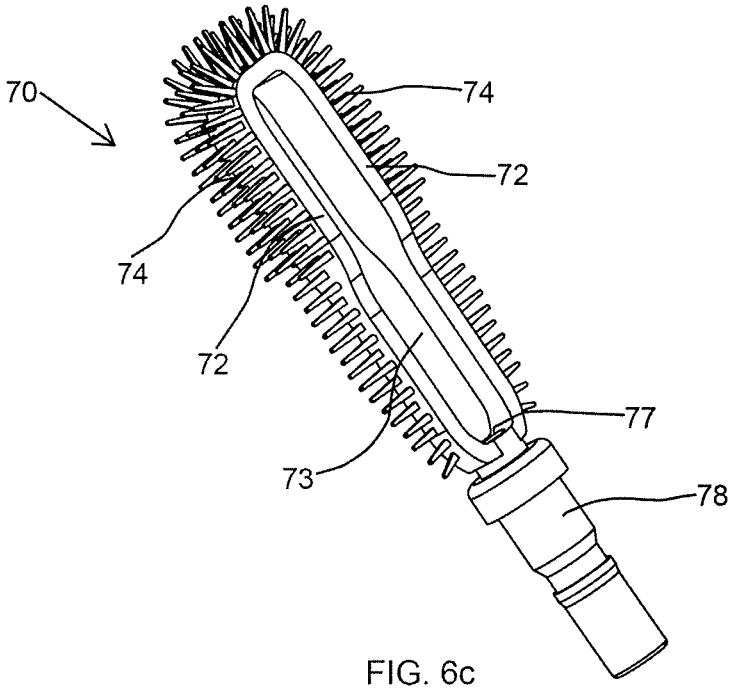

As seen in FIGS. 6*a* to 6*c*, the applicator head 70 comprises at least two support members 72 defining an opening 73 between them. Each of the at least two support members 72 extends along the central longitudinal axis X-X from a shank portion 78 of the applicator head 70 to a distal end of the applicator head 70. Each of the at least two support members 72 has an outer applicator surface facing away from the central longitudinal axis X-X and having a plurality of application elements 74 on it. Further, each of the at least two support members 72 has a proximal portion 72*a* and a distal portion 72*b* as shown in FIG. 6*b*.

As seen in FIGS. 6*a*-6*c*, the plurality of application elements 74 are tines. It would not be beyond the scope of present disclosure if the application elements 74 are chosen from a group of application elements consisting of bristles, teeth, discs, ribs and flocking.

As shown in FIGS. 6*a* and 6*b*, each of the at least two support members 72, has a width "W" greater than its thickness "D" along its entire length "L". The width of the at least one of the at least two support members 72 is not constant along the length of said support member 72. The width "W" of each of the at least two support members 72 is more in distal portion 72*b* than in proximal portion 72*a* of said support member 72. More specifically, the width "W" of each of the at least two support members 72 is more in substantially distal half of its length "L" than in proximal half of its length "L". Further, each of the at least two support members 72, has more application elements 74 in distal portion 72*b* than in the proximal portion 72*a* of said support member 72. More specifically, each of the at least two support members 72, has more application elements 74 in distal half of its length "L" than in proximal half of its length "L". Each of the at least two support members 72, has more number of rows "r" of application elements 74 in distal half of its length "L" than in proximal half of its length "L". Each of the at least two support members 72, has at least three rows "r" of application elements 74 in distal half of its length "L" and only single row "r" of application elements 74 in proximal half of its length "L".

Further as shown in FIGS. 6*a* and 6*c*, free ends 75 of application elements 74 of one of the at least two support members 72 face in a direction opposite to a direction of free ends 75 of application elements 74 of other of the at least two support members 72.

Figure 4:
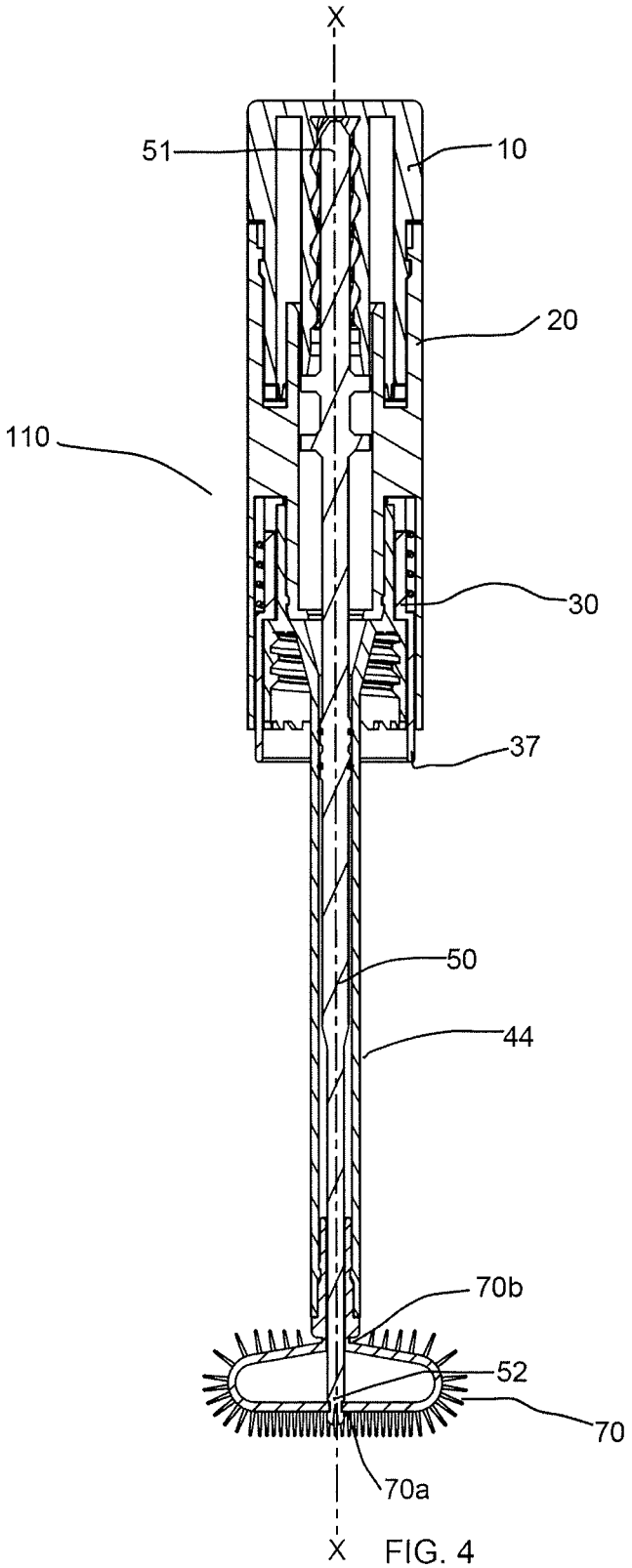
FIG. 4 illustrates a cross sectional view of the adjustable applicator of the cosmetic package of FIG. 2, showing an applicator head of the adjustable applicator in a first configuration.

When the dialer 10 is rotated, the applicator head 70 can adopt at least two stable configurations that is to say a first configuration as shown in FIG. 4 in which the inner rod 50 is moved to its maximum extent towards proximal direction and a second configuration as shown in FIG. 3*a* in which the inner rod 50 is moved to its maximum extent towards distal direction.

According to an embodiment of the disclosure, in the first configuration, the distal end 70*a* of the applicator head 70 is moved to its maximum extent towards the proximal end 70*b* of the applicator head 70 and in the second configuration, the distal end 70*a* of the applicator head 70 is moved to its maximum extent away from the proximal end 70*b* of the applicator head 70.

Figure 5A:
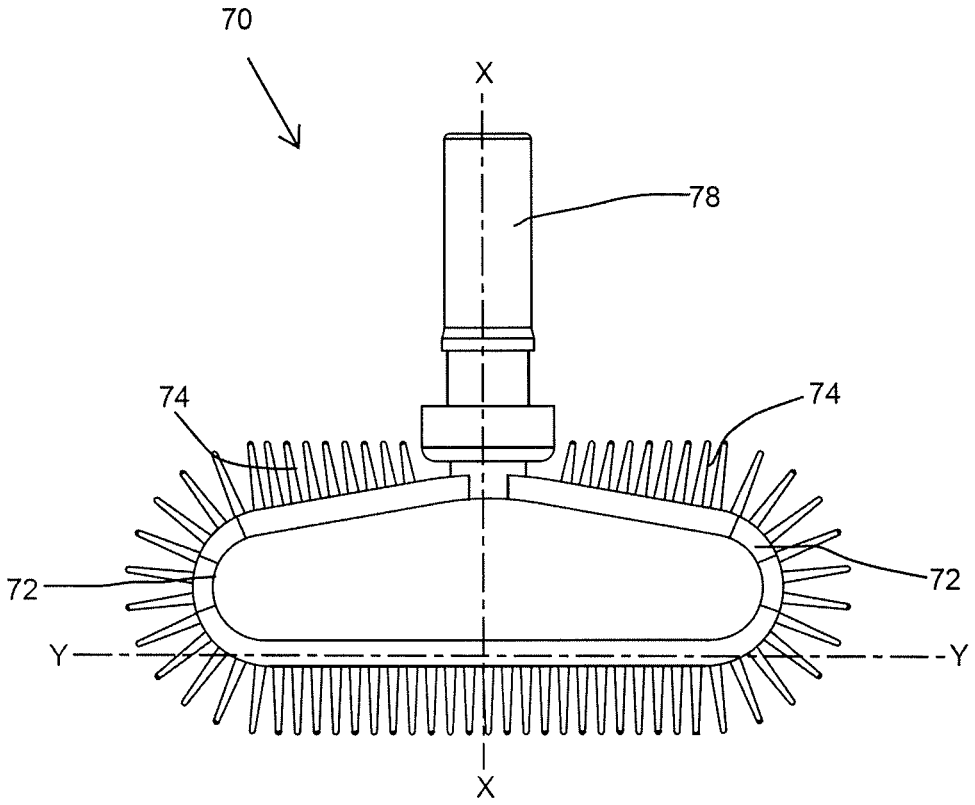
FIGS. 5*a* and 5*b* illustrate a front view and a bottom view of the applicator head of FIG. 4 in the first configuration.
Figure 5B:
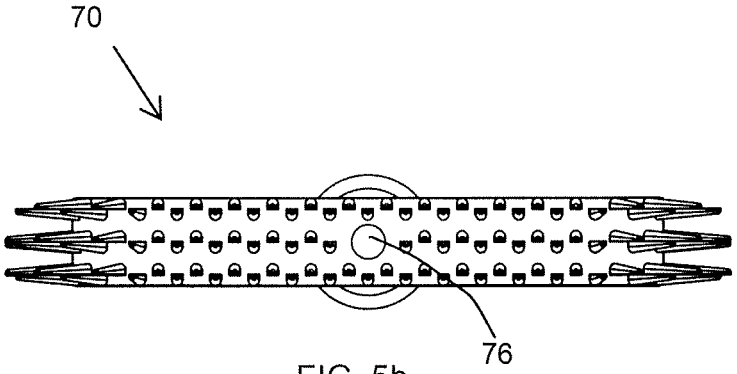

According to an embodiment of the disclosure, in the first configuration of the applicator head 70 as shown in FIGS. 4, 5*a* and 5*b*, a portion of the applicator head 70 is extended in a direction along an axis Y-Y, perpendicular to the longitudinal axis X-X of the adjustable applicator 100. In other words, the applicator head 70 adopts a T-shape in first configuration, by radially outward deformation of the at least two support members 72. Alternately, in the first configuration, a portion of the applicator head 70 is extended in a horizontal direction. Further, as seen in FIGS. 4 and 5*a*, in the first configuration, at least distal half of the length of each of the at least two support members 72 of the applicator head 70 is extended in a horizontal direction or in a direction perpendicular to the longitudinal axis X-X of the adjustable applicator 100.

In the second configuration as shown in FIGS. 3*a*-3*b*, 6*a*-6*c*, the applicator head 70 is again extended along the longitudinal axis X-X of the adjustable applicator 100 so that the adjustable applicator 100 can be again retained on the receptacle 200. Further, in the second configuration, the at least two support members 72 of the applicator head 70 are extended along the longitudinal axis X-X of the adjustable applicator 100.

According to present embodiment of the disclosure, in the first configuration as shown in FIGS. 4, 5*a* and 5*b*, at least a part of a distal portion 72*b* of each of the at least two support members 72 is extended in a horizontal direction which is perpendicular to the longitudinal axis X-X of the adjustable applicator and in the second configuration, each of the at least two support members 72 is extended along the longitudinal axis X-X of the adjustable applicator 100.

Further, in the first configuration, as shown in FIGS. 4, 5*a* and 5*b*, a majority of the plurality of application elements 74 present on the outer surface of the at least two support members 72 are parallel to the longitudinal axis X-X of the adjustable applicator 100; and wherein in the second configuration, as shown in FIGS. 3*a*-3*b*, 6*a*-6*c*, a majority of the plurality of application elements 74 present on the outer surface of the at least two support members 72 are non-parallel to the longitudinal axis X-X of the adjustable applicator 100.

According to an alternate embodiment of the disclosure, in an improved mode of implementation, provision may be made for the applicator head 70 to be maintained in intermediate state (not shown) wherein in one of the intermediate states a distal portion of the applicator head 70 forms a V-shape and a proximal portion of the applicator head 70 forms an inverted V-shape.

According to an alternate embodiment of the disclosure, in other intermediate states (not shown) the distal portion of each of the at least two support members 72 form an angle more than zero degree but less than 90 degree with the longitudinal axis X-X of the adjustable applicator 100.

As shown in FIGS. 1-3*a*, 5*b*, 6*a* and 6*c*, the inner rod 50 is connected in a cavity 76 (shown in FIG. 5*b*) at the distal end of the applicator head 70 and runs through an opening 73 between the at least two support members 72 into a cavity 77 formed in a proximal portion of the applicator head 70 and then into the hollow stem 40 and the dialer 10. The proximal portion of the applicator head 70 forms a shank 78 which is connected at a distal end of the hollow stem 40.

As shown in FIGS. 2-4 and FIG. 7, the dialer 10 is structured in a closed-end cylindrical shape which is provided with a tube portion 16 having a small outer diameter, and an annular protruding portion 16*b* is provided on an outer peripheral surface of the tube portion 16 for attaching the dialer 10 to the sleeve 20. The sleeve 20 is attached with the dialer 10 such that the sleeve 20 is free to rotate relative to the dialer 10 via a snap-fit system comprising the external annular protruding portion 16*b* and a complementary annular groove 28 of the sleeve 20. The dialer 10 can thus be turned by the user relative to the sleeve 20. The dialer 10 further includes an internal annular skirt 14 projecting from an inner surface of a top wall 18 of the dialer 10 and the internal annular skirt 14 extends towards the receptacle 200. Preferably, the internal annular skirt 14 is coaxial with the tube portion 16. The inner surface of the internal annular skirt 14 includes an inner profile, such as mating threads 14*a* capable of interacting with an outer thread 53 of the inner rod 50 mounted axially inside the dialer 10.

Figure 7:
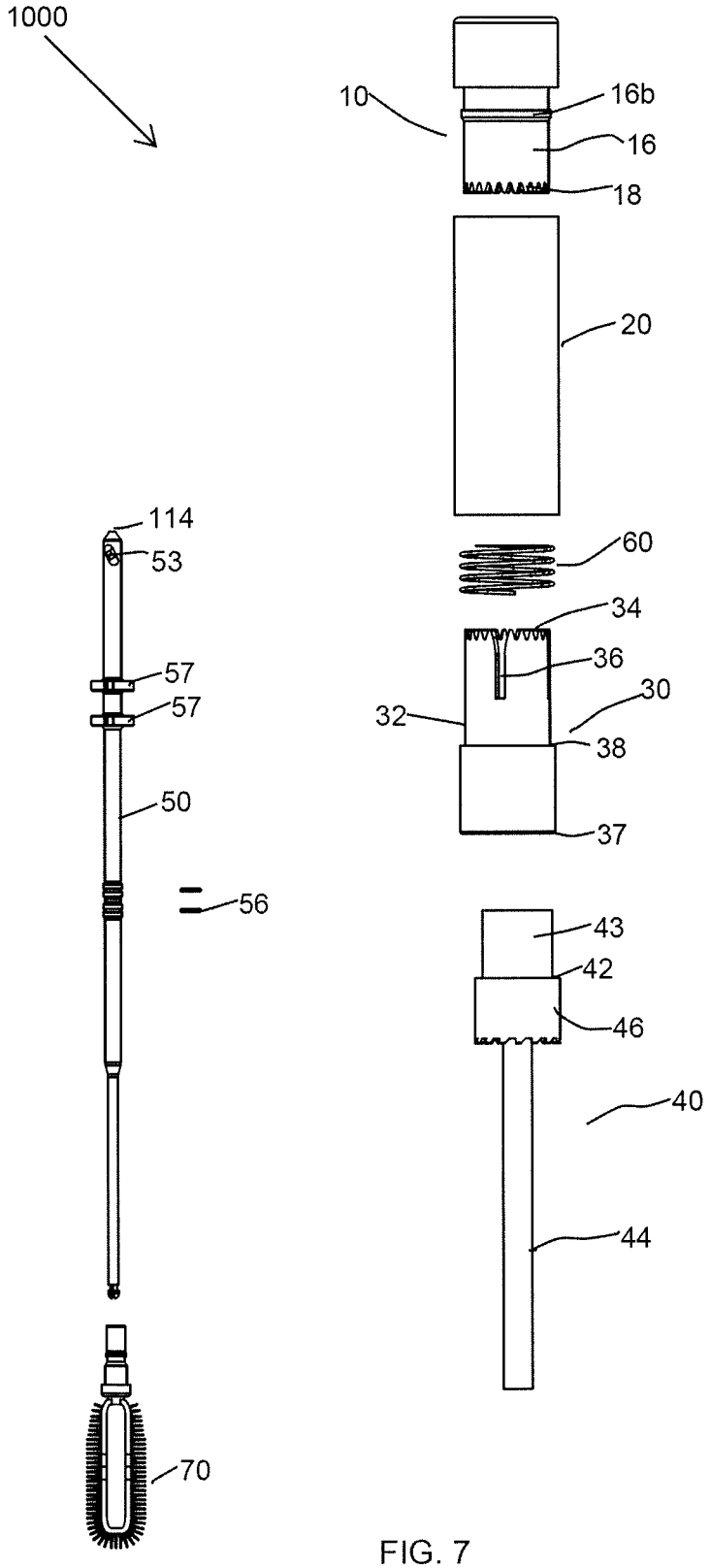
FIG. 7 illustrates an exploded view of the adjustable applicator of FIG. 3*a;*
Figure 8A:
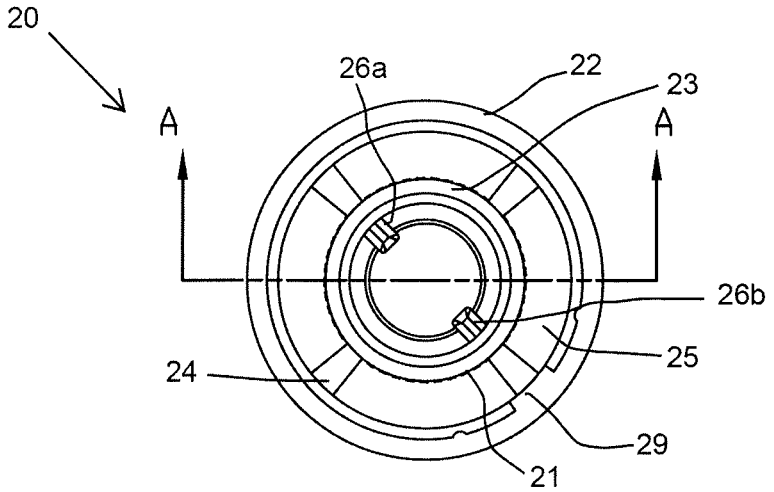
FIG. 8A illustrates a top view of a lower portion/sleeve of gripping member of the adjustable applicator of FIG. 3*a;*
Figure 8B:
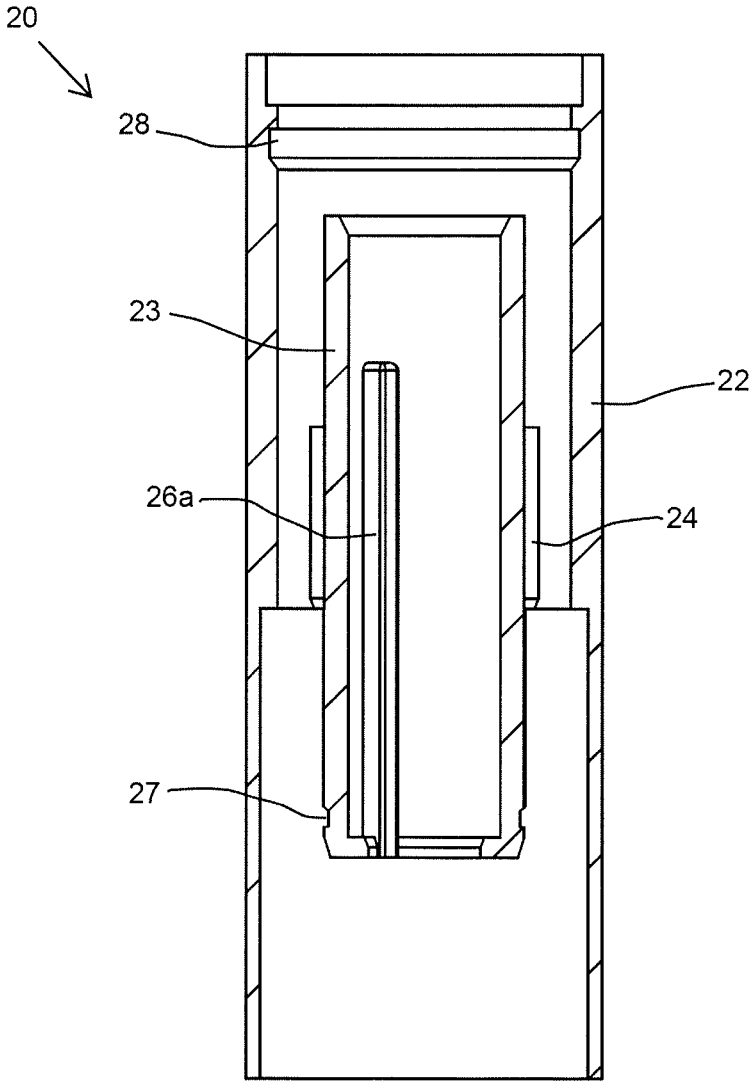
FIG. 8B illustrates a sectional view of the lower portion/sleeve of gripping member taken along an axis A-A of FIG. 8A.

As shown in FIGS. 8A and 8B, the sleeve 20 of the gripping member 110 comprises two concentric cylinders 22, 23 joined together by linking ribs 24, i.e. a larger diameter outer cylinder 22 is disposed around a hollow inner cylinder 23 and the linking ribs 24 connect an outer surface of the inner cylinder 23 to inner surface of the outer cylinder 22. According to a preferred embodiment, the linking ribs 24 are radially disposed such that there are hollow spaces 25 between the adjacent linking ribs 24. In the embodiment shown, there are four linking ribs 24 disposed radially. The outer cylinder 22 further comprises an internal annular groove 28 for attaching to an external annular protruding portion 16*b* of the dialer 10 (shown in FIG. 7). The inner cylinder 23 includes longitudinal guide protrusions 26*a* and 26*b* at its inner surface for guiding axial movement of the inner rod 50 and for preventing inner rod 50 from rotating, when the dialer 10 is twisted.

Figure 10:
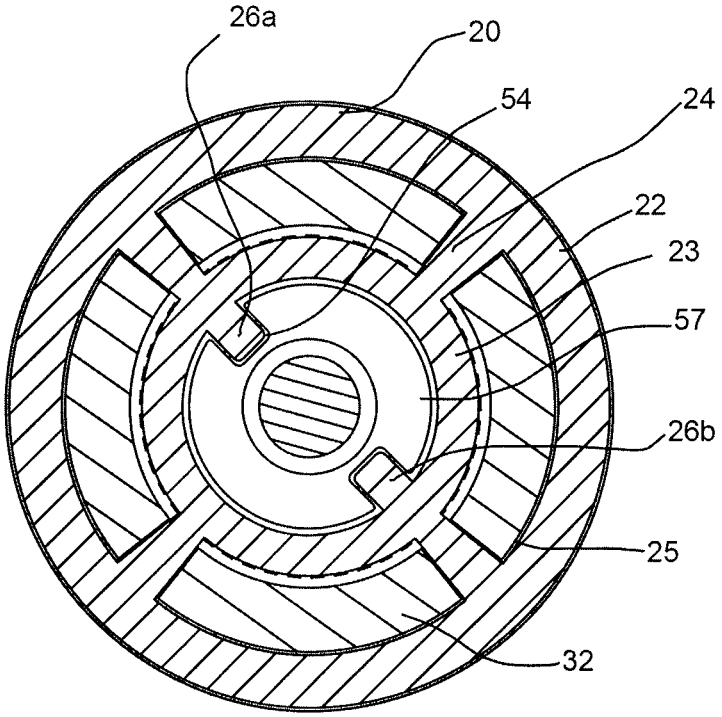
FIG. 10 illustrates a cross section of the cosmetic package of FIG. 2 taken along an axis B-B.

As seen in FIGS. 2 and 10, for engaging the stem 40 to sleeve 20 of the gripping member 110, a portion of inner cylinder 23 is inserted/received into an upper tubular portion 43 of the stem 40 and the outer surface of the inner cylinder 23 has a groove 27 for engaging complementary protrusion 45 present on the inner surface of the upper tubular portion 43 of the stem 40. On the interfaces where the stem 40 is joined to the sleeve 20 of the gripping member 110, the stem 40 and the sleeve 20 of the gripping member 110 both have complementary longitudinal protrusions and positioning longitudinal grooves that engage with each other for non-rotatably locking the stem 40 and the sleeve 20 together. For example as seen in FIG. 8A, the outer surface of inner cylinder 23 of the sleeve 20 includes a plurality of longitudinal protrusions 21 which is arranged to become in mating engagement with complementary grooves 41 (see FIG. 11) at an inner surface of the stem 40 or vice versa, for non-rotatable engagement. However, it is not beyond the ambit of the present disclosure that any other non-rotatable engagement known in the art may be employed for locking any relative rotation between the stem 40 and the sleeve 20.

Figure 11:
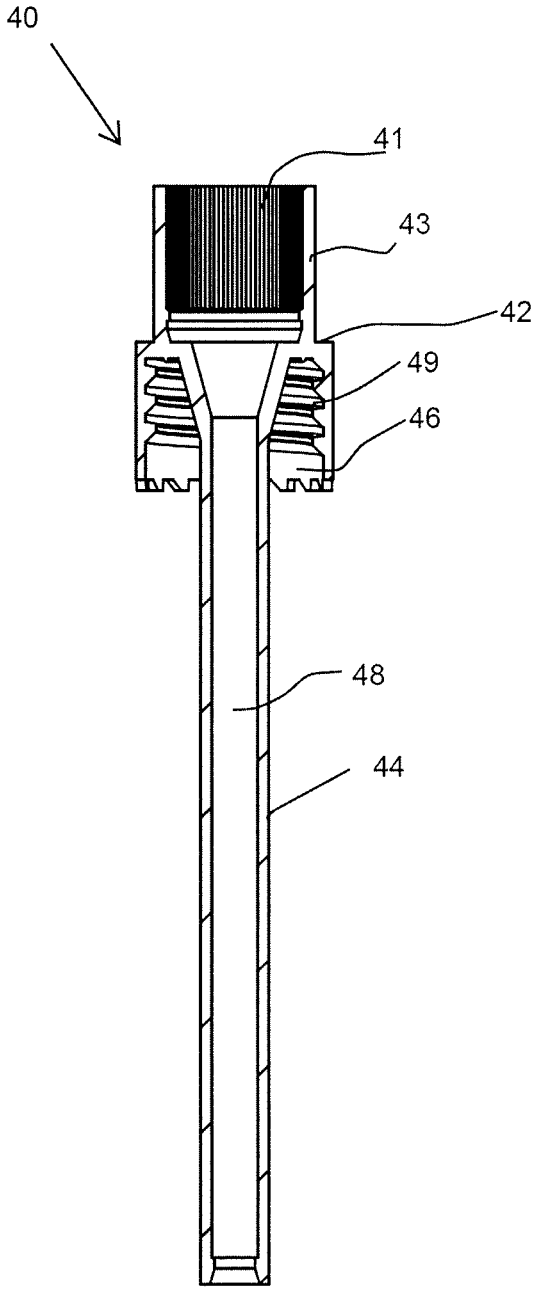
FIG. 11 illustrates a sectional view of a stem of the cosmetic package of FIG. 2.

Further, as seen in FIGS. 2, 7 and 11, the stem 40 comprises the upper tubular portion 43, a downward skirt 46, a joint 42 defined between the upper tubular portion 43 and the downward skirt 46, and an elongated hollow shaft 44. The threads 49 are provided on the inner peripheral surface of the downward skirt 46 of the stem 40 (see FIGS. 1 & 11) to attach the gripping member 110 to an externally threaded neck 220 of the container 200. With the gripping member 110 so attached, the applicator head 70 is immersed in the product P to be applied. The elongated hollow shaft 44 extends beyond the neck 210 in the receptacle 200. Preferably, the elongated hollow shaft 44 of the stem 40 is disposed around at least a portion of the inner rod 50 so that the inner rod 50 is longitudinally movable with respect to the shaft 44. In the embodiment illustrated, the shaft 44 and the inner rod 50 have circular transverse cross-sections. Other embodiments may have non-circular transverse cross-sections.

Figure 9A:
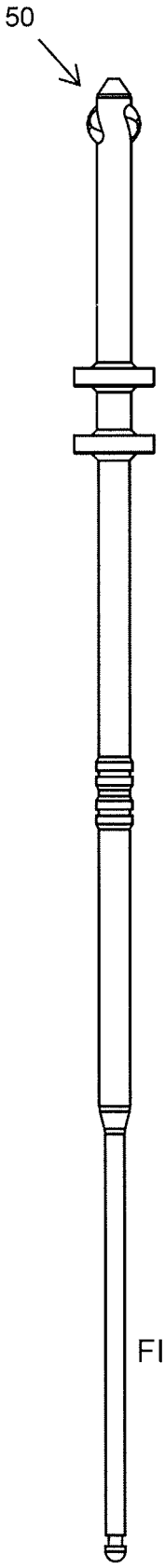
FIG. 9A illustrates a front view of an inner rod of the cosmetic package of FIG. 2.
Figure 9B:
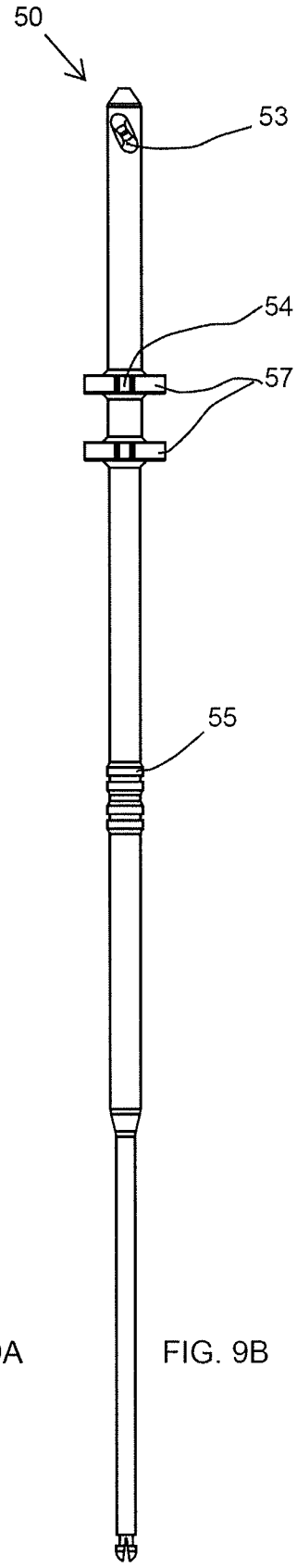
FIG. 9B illustrates a side view of the inner rod of FIG. 9A.
Figure 9C:
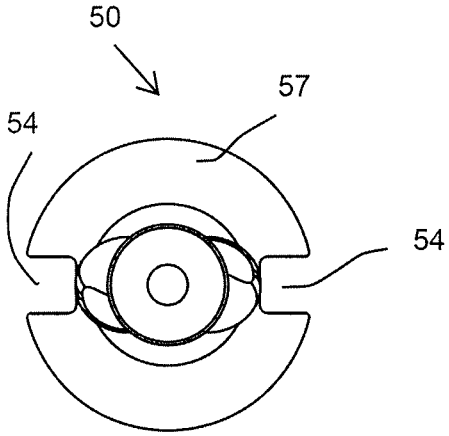
FIG. 9C illustrates an enlarged top view of the inner rod of FIG. 9A.

In the embodiment, the gripping member 110 further includes such features that allow an axial movement of the inner rod 50 but rotation of the inner rod 50 is prevented when the dialer 10 is rotated with respect to the sleeve 20. For example, as seen in FIGS. 9A-10, the inner rod 50 includes outer thread 53 at its upper part, two annular flanges 57 having two opposing slide cut-outs 54 for receiving the longitudinal guide protrusions 26*a* and 26*b* of the sleeve 20. Further, one or more annular ribs 55 and sealing O-rings 56 are configured around the inner rod 50 so that the inner rod 50 interfaces tightly against an inner wall of the shaft 44 (see FIG. 2). The annular ribs 55 and the sealing O-rings 56 prevent the product P from leaking and ensure steady, smooth, and noiseless extension of the inner rod 50 along the shaft 44.

In unlocked configuration of the cosmetic package 1000, when the dialer 10 is rotated with respect to the sleeve 20, the inner rod 50 moves longitudinally with respect to the shaft 44 which cause variation in the profile of the applicator head 70 as explained above. When a suitable adjustment of the profile of the applicator head 70 has been made it will be retained while the applicator head 70 is used. The adjustment is retained until the user intentionally rotates the dialer 10 and the sleeve 20 with respect to each other once again to achieve a different adjustment.

So that the dialer 10 is prevented from rotating with respect to the sleeve 20 in the locked configuration, there is provided in the gripping member 110, a locking member 30. The locking member 30 engages and disengages with the dialer 10 to respectively lock and unlock the rotation of the dialer 10 with respect to the sleeve 20 in respective locked and unlocked configuration. As shown in the FIG. 7, the locking member 30 has a barrel body 32 having teeth 34 at its first end and an annular shoulder 38 defined at its outer periphery. The barrel body 32 is slidably mounted in an annular space defined between the sleeve 20 and the stem member 40 (see FIG. 2). The teeth 34 are present on a top peripheral edge of the barrel body 32 for engagement with the complementary teeth 18 of the dialer 10. The locking member 30 further includes longitudinal cut outs 36 on the barrel body 32, the longitudinal cut outs 36 open at the top peripheral edge of the barrel body 32 having teeth 34. Referring to FIGS. 7 and 10, the longitudinal cut outs 36 are provided so that the top part of the barrel body 32 is able to slide into hollow spaces 25 present between the linking ribs 24 of the sleeve 20 for engaging with the dialer 10 and thereby also non-rotatably engaging the locking member 30 with the sleeve 20. There is also provided a spring 60 that surrounds a portion of the barrel body 32 above the shoulder 38 such that one end of the spring 60 abuts the linking ribs 24 and its other end abuts the shoulder 38 and wherein the spring 60 urges the barrel body 32 in a direction away from the dialer 10.

Referring to FIG. 2, when the adjustable applicator 100 is screwed on the receptacle 200, the shoulder 240 abuts the distal end 37 of the locking member 30 and exerts an upward sliding force upon the locking member 30 pushing it upward against the downward biasing force of the spring 60 thereby compressing the spring 60 and engaging the teeth 34 of the locking member 30 with the complementary teeth 18 of the dialer 10. In the closed position of the cosmetic package 1000, the dialer 10, the sleeve 20, the stem 40 and the locking member 30 are engaged in non-rotatable manner with respect to one other. Therefore, the dialer 10 can't be rotated independently of the sleeve 20 i.e. when the dialer 10 is rotated, the sleeve 20 also rotates simultaneously as the locking member 30 engages the dialer 10 to sleeve 20 in a non-rotatable engagement. Moreover, the sleeve 20 is also non-rotatably engaged to the stem 40 and therefore, it causes rotation of the gripping member 110 in whole and rotation thus leads to unscrewing of the gripping member 110 from the receptacle 200 without causing actuation of the dialer 10.

Referring now to FIGS. 3*a* and 3*b*, once the gripping member 110 is unscrewed, the locking member 30 is pushed downward due to biasing/restoring force of the spring 60 and the locking member 30 slides downwards disengaging itself from the dialer 10 and thereby disengaging the teeth 34 and the teeth 18 of the dialer 10. The dialer 10 thus becomes free to rotate with respect to the sleeve 20. Now to transform the profile of the applicator head 70 as shown in FIG. 4, the dialer 10 is twisted in first direction and the rotational movement of the dialer 10 is converted into translational movement of the inner rod 20 by the rotational movement of the threads 14*a* within the inner skirt 14 of the dialer 10. Therefore, the inner rod 50 is now able to retract towards the proximal end of the shaft 44. As the inner rod 50 is retracted to its maximum extent towards the proximal end, the profile of applicator head 70 changes as shown in FIG. 4, due to pressure applied on it by the axial movement of the inner rod 50. The inner rod 50 can be adjusted to various relative longitudinal positions with respect to the shaft 44 depending on degree of twisting, such that as adjustment is made, profile of the applicator head 70 varies. Once the adjustment is made, it will be retained without any action by the user, until further adjustment is desired and intentionally made.

Further, the user can rotate the dialer 10 in opposite direction to extend the inner rod 50 towards the distal end of the shaft 44. As the inner rod 50 is extended to its maximum extent towards the distal end, the profile of applicator head 70 changes to second configuration as shown in FIGS. 3*a* and 3*b*.

According to present embodiment, to avoid the inner rod 50 from being moved completely out of the internal threads 14*a* of the dialer 10 when the dialer 10 is rotated, there is provided a projecting stop 29 (See FIG. 8A) on inner surface of the outer cylinder 22 which prevents the complete or over-rotation of the dialer 10 i.e. the dialer 10 cannot be rotated to 360 degree or more with respect to the sleeve 20 in one particular direction and therefore doesn't run out of length of the internal threads 14*a* of the dialer 10. According to present embodiment, the threads 14*a* of the dialer 10 and the threads 49 of the adjustable applicator 100 are preferably threads in opposite directions.

According to present embodiment of the disclosure, the at least two support members 72 of the applicator head 70 may be molded as a single piece from an elastically deformable or a flexible material. The support members 72 may be produced from an elastomer or any other elastic material allowing compression and expansion of the support members 72 or may be made from any other polymeric material which is flexible in nature.

According to another embodiment of the disclosure, the at least two support members 72 of the applicator head 70 may be molded by bi-injecting two materials having different properties for e.g. different hardness, color etc.

The materials suitable for forming the receptacle 200 could be polypropylene while the dialer 10, the sleeve 20, the inner rod 50, the stem 40, and the locking member 30 could be formed of acrylonitrile butadiene styrene or any other suitable polymeric material. The material of the inner rod 50 could be any polymeric material like nylon, TPE, PP or could be a suitable metal. The stem 40 may be formed of polyacetal or any other suitable polymeric material. The material for forming the wiper 80 could be low-density polyethylene. The aforementioned materials for forming various parts of the package of the present disclosure are an example, however other suitable materials may also be used.

Although the above description and drawings show the package being cylindrical, the shapes and profile cross section thereof are not limited to the same.

While the foregoing is directed to embodiments of the present disclosure, other and further embodiments of the disclosure may be devised without departing from the basic scope thereof, and the scope thereof is determined by the claims that follow.

What is claimed is:

1. An adjustable applicator extending along a longitudinal axis and comprising:

an applicator head having a distal end and a proximal end; the applicator head comprising:

a shank having a first end and a second end opposite the first end, the first end configured to couple to a hollow shaft;

at least two support members, wherein the at least two support members define an opening between them, wherein distal ends of the at least two support members are coupled to each other and proximal ends of the at least two support members are fixed to the second end of the shank; and a plurality of application elements disposed at least on an outer surface of the at least two support members such that the plurality of application elements are disposed along a length of the at least two support members from the distal ends to the proximal ends of the at least two support members;

wherein the applicator head is capable of adopting at least a first configuration and a second configuration;

wherein in the first configuration, the distal end of the applicator head is disposed closer to the proximal end of the applicator head and at least a part of a distal portion of each of the at least two support members is extended in a direction perpendicular to the longitudinal axis of the adjustable applicator; and wherein in the second configuration, the distal end of the applicator head is disposed further from the proximal end of the applicator head than when in the first configuration.

2. The adjustable applicator of claim 1, wherein in the first configuration, the distal end of the applicator head is at its maximum extend towards the proximal end of the applicator head, and in the second configuration, the distal end of the applicator head is at its maximum extent away from the proximal end of the applicator head.

3. The adjustable applicator of claim 1, wherein each of the at least two support members, has a width greater than a thickness along its entire length.

4. The adjustable applicator of claim 3, wherein the width of each of the at least two support members is more in the distal portion of its length than in a proximal portion of its length.

5. The adjustable applicator of claim 1, wherein each of the at least two support members, has more number of application elements in the distal portion of its length than in a proximal portion of its length.

6. The adjustable applicator of claim 1, wherein the plurality of application elements are chosen from a group of application elements consisting of tines, bristles, teeth, discs, ribs and flocking.

7. The adjustable applicator of claim 1, wherein the adjustable applicator further comprises a stem and a gripping member, the stem including the hollow shaft; wherein the applicator head is connected to a distal end of the stem and the gripping member is connected to a proximal end of the stem; and wherein an actuator is formed by an upper portion of the gripping member.

8. The adjustable applicator of claim 7, wherein the actuator is capable of assuming a locked configuration and an unlocked configuration; wherein in the locked configuration, the actuator cannot be actuated to change the shape of applicator head; and wherein in the unlocked configuration, the actuator can be actuated to change the shape of the applicator head.

9. The adjustable applicator of claim 7, wherein the adjustable applicator further comprises an inner rod extending through the applicator head and which is capable of moving along the longitudinal axis to cause progressive modification in shape of the applicator head.

10. The adjustable applicator of claim 9, wherein the inner rod comprises a material selected from a polymeric material and metals.

11. The adjustable applicator of claim 9, wherein a distal end of the inner rod is connected at the distal end of the applicator head and a proximal end of the inner rod is connected to the actuator, and wherein the actuator is actuated for moving the inner rod along the longitudinal axis.

12. The adjustable applicator of claim 11, wherein the actuator is connected to the proximal end of the inner rod in such a way that rotational movement of the inner rod with respect to the actuator is restricted while translational movement is allowed.

13. The adjustable applicator of claim 11, wherein the inner rod is non-rotatably connected at its distal end to the distal end of the applicator head.

14. The adjustable applicator of claim 9, wherein when the inner rod is lifted or moved towards proximal direction it causes the applicator head to be radially outwardly deformed in a way that the distal end of the applicator head moves towards the proximal end of the applicator head, and when the inner rod is lowered or moved towards distal direction it causes the distal end of the applicator head to move away from the proximal end of the applicator head.

15. The adjustable applicator of claim 14, wherein when the inner rod is moved to its maximum extent towards proximal direction, the applicator head achieves the first configuration and wherein when the inner rod is moved to its maximum extent towards distal direction the applicator head achieves the second configuration.

16. The adjustable applicator of claim 14, wherein in the intermediate state, the distal portion of each of the at least two support members forms a V-shape.

17. The adjustable applicator of claim 1, wherein the at least two support members of the applicator head are molded as a single piece from an elastically deformable or a flexible material.

18. The adjustable applicator of claim 1, wherein the at least two support members of the applicator head are molded by bi-injecting two materials having different properties.

19. An adjustable applicator extending along a longitudinal axis and comprising:

a hollow shaft;

an applicator head separable from the hollow shaft, the applicator head having a distal end and a proximal end; the applicator head comprising:

a shank having a first end and a second end opposite the first end, the first end configured to couple to the hollow shaft;

at least two support members, wherein the at least two support members define an opening between them, wherein distal ends of the at least two support members are coupled to each other and proximal ends of the at least two support members are fixed to the second end of the shank; and a plurality of application elements disposed on at least a portion of an outer surface of the at least two support members such that the plurality of application elements are disposed along a length of the at least two support members from the distal ends to the proximal ends of the at least two support members;

wherein the applicator head is capable of adopting at least a first configuration, a second configuration, and an intermediate state;

wherein in the first configuration, the distal end of the applicator head is disposed closer to the proximal end of the applicator head and at least a part of a distal portion of each of the at least two support members is extended in a direction perpendicular to the longitudinal axis of the adjustable applicator; and wherein in the second configuration, the distal end of the applicator head is disposed further from the proximal end of the applicator head than when in the first configuration; and wherein in the intermediate state, the distal portion of each of the at least two support members forms an angle more than zero degree but less than 90 degree with the longitudinal axis of the adjustable applicator.

20. An adjustable applicator extending along a longitudinal axis and comprising:

an applicator head having a distal end and a proximal end; the applicator head comprising:

a shank having a first end and a second end opposite the first end, the first end configured to couple to a hollow shaft;

at least two support members, wherein the at least two support members define an opening between them, wherein distal ends of the at least two support members are coupled to each other and proximal ends of the at least two support members are fixed to the second end of the shank; and a plurality of application elements disposed on at least a portion of an outer surface of the at least two support members such that the plurality of application elements are disposed along a length of the at least two support members from the distal ends to the proximal ends of the at least two support members;

wherein the applicator head is capable of adopting at least a first configuration and a second configuration;

wherein in the first configuration, the distal end of the applicator head is disposed closer to the proximal end of the applicator head and at least a part of a distal portion of each of the at least two support members is extended in a direction perpendicular to the longitudinal axis of the adjustable applicator; and wherein in the second configuration, the distal end of the applicator head is disposed further from the proximal end of the applicator head than when in the first configuration and a majority of the plurality of application elements present on the outer surface of the at least two support members are non-parallel to the longitudinal axis of the adjustable applicator.

* * * * *